US006723948B2

(12) United States Patent
Hesterman

(10) Patent No.: US 6,723,948 B2
(45) Date of Patent: Apr. 20, 2004

(54) DEVICE FOR PROCESSING PRINTED PACKAGING OR SIMILAR SUBSTRATES

(75) Inventor: Ebe Hesterman, Badhoevedorp (NL)

(73) Assignee: Schober GmbH, Eberdingen (DE)

( * ) Notice: Subject to any disclaimer, the term of this patent is extended or adjusted under 35 U.S.C. 154(b) by 0 days.

(21) Appl. No.: 10/240,714

(22) PCT Filed: Mar. 2, 2001

(86) PCT No.: PCT/EP01/02360

§ 371 (c)(1),
(2), (4) Date: Oct. 4, 2002

(87) PCT Pub. No.: WO01/76834

PCT Pub. Date: Oct. 18, 2001

(65) Prior Publication Data

US 2003/0136240 A1 Jul. 24, 2003

(30) Foreign Application Priority Data

Apr. 8, 2000 (DE) ..... 200 06 554 U

(51) Int. Cl.[7] ..... B26D 7/18
(52) U.S. Cl. ..... 219/121.6
(58) Field of Search ..... 219/121.6, 121.67, 219/121.68, 121.69, 121.7, 121.71, 121.72; 83/152, 343, 665, 678; 493/354, 8, 30, 369; 271/82

(56) References Cited

U.S. PATENT DOCUMENTS

| | | | | |
|---|---|---|---|---|
| 3,203,292 A | | 8/1965 | Schermund | |
| 3,383,991 A | | 5/1968 | Sarka | |
| 3,552,281 A | * | 1/1971 | Feick | 493/354 |
| 3,578,761 A | * | 5/1971 | Sarka | 83/343 |
| 3,667,354 A | * | 6/1972 | Steinmetz | 493/8 |
| 3,699,831 A | * | 10/1972 | Mowry | 83/94 |
| 4,517,873 A | | 5/1985 | Wilson | |
| 4,604,083 A | | 8/1986 | Barny | |
| 5,163,891 A | | 11/1992 | Goldsborough | |
| 5,388,490 A | | 2/1995 | Buck | |

FOREIGN PATENT DOCUMENTS

| | | |
|---|---|---|
| DE | 1 018 712 | 10/1957 |
| DE | 37 30 392 | 3/1989 |
| GB | 1 155 178 | 6/1969 |

* cited by examiner

*Primary Examiner*—M. Alexandra Elve
*Assistant Examiner*—Jonathan Johnson
(74) *Attorney, Agent, or Firm*—Paul Vincent

(57) ABSTRACT

A device for enhancing and processing printed cardboard, cardboard packaging, paperboard, paper or similar substrates (2), especially designed for a rotational stamping process, wherein the substrate (2) can be introduced in between two rotating processing cylinders (4, 5) in an advance direction (A) and is processed as it passes there through by tool parts (7, 8) acting in a working gap (6). The inventive device (1; 1'; 1"; 1'") is provided with a processing cylinder (4) having at least one gripper (9) for register-controlled conveyance of the substrate (2).

19 Claims, 9 Drawing Sheets

DEVICE FOR PROCESSING PRINTED PACKAGING OR SIMILAR SUBSTRATES

BACKGROUND OF THE INVENTION

The invention concerns a device for punching printed cardboard, cardboard packagings, envelopes or similar subtates in accordance with the independent claim.

Conventional devices for processing printed substrates (U.S. Pat. No. 4,604,083) are formed as an integral part of a printing machine for processing sheets, wherein a printed substrate to be punched is inserted, via sliding elements, between rotating rollers and is processed by punching tool parts located on the roller peripheral surface. A register-controlled superposition of the printing with the finishing step is very difficult from a technical point of view and the processing accuracy is adversely affected.

The invention addresses the problem of creating a device for punching printed material, in particular packaging means or similar substrates, which can be used as an additional construction unit for almost any printing machine, which improves the processing accuracy in sheet printing through precise positional transfer of the substrate, and which can be rapidly adjusted to changed processing shapes as well as different substrates.

SUMMARY OF THE INVENTION

The invention achieves this object with a device having the features characterizing the independent claim. Further substantial design features are given in the dependent claims.

The inventive device for punching previously printed substrates has two conventional processing rollers, at least one of which has a gripper proximate its peripheral tool part to grasp the printed sheet, which is to be transported as a substrate, in a register-controlled fashion and introduce same into a register-controlled transport position between the processing rollers.

The rotating processing rollers and integrated gripper form a functional unit and the device therefore permits punching of the substrate during the same production sequence in which printing occurs. The range of applications of the device can also be augmented by embossing and/or perforation procedures. The substrate can be directly processed by a printing machine disposed upstream of the device in such a manner that this printing machine and the finishing device can be operated synchronously at high speed. The printed image and processing shape of the subsequent tool parts are thereby superposed in a register-controlled fashion and with improved accuracy. Different substrates can be processed with changed processing shapes after short retooling times such that the overall productivity of the processing sequence is increased by combining processing procedures.

BRIEF DESCRIPTION OF THE DRAWINGS

Further details and advantages of the invention can be extracted from the following description and the drawings which show two embodiments of the inventive device.

DESCRIPTION OF THE PREFERRED EMBODIMENT

Figure 1:
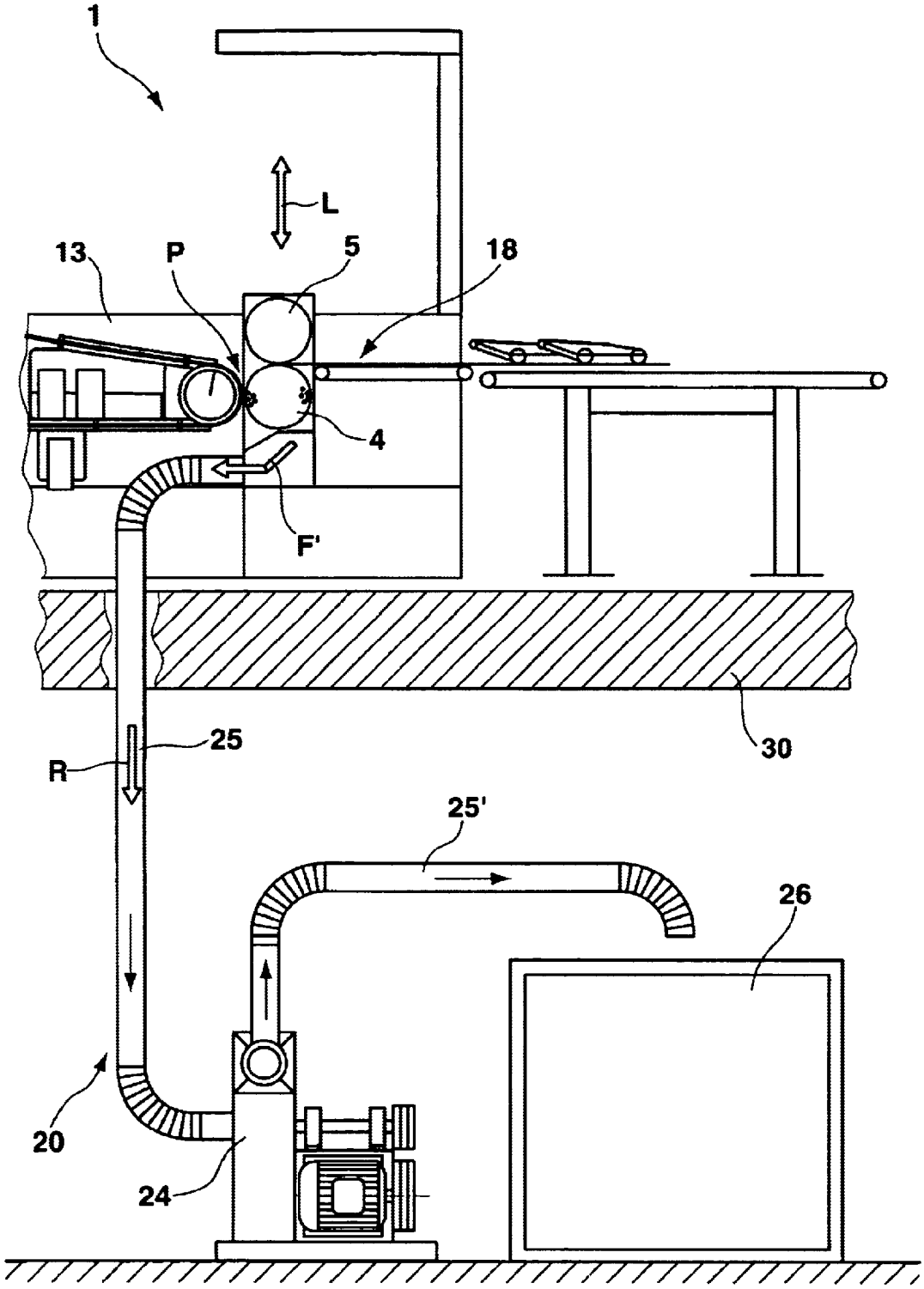
FIG. 1 provides a schematic illustration of the device for punching a worked material and having a disposing unit to receive waste.
Figure 4:
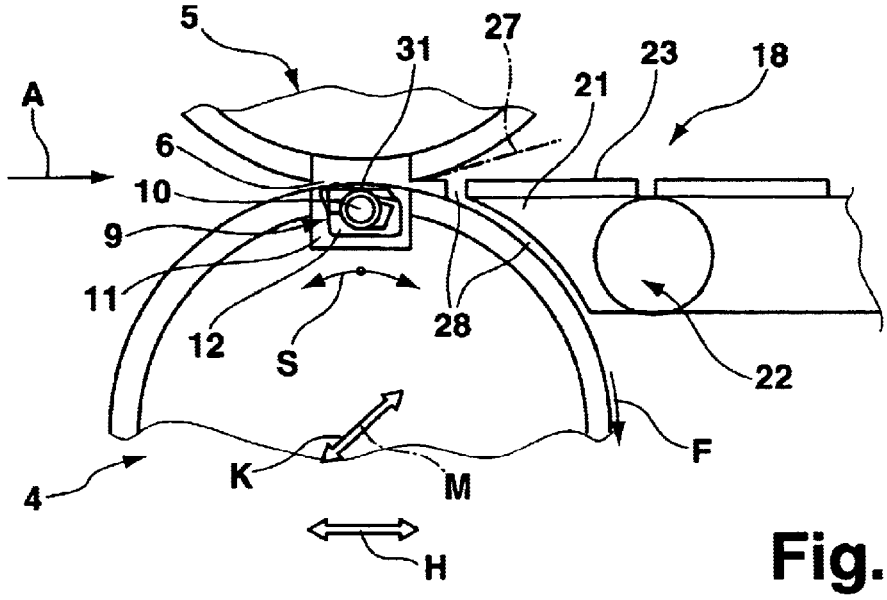
FIG. 4 shows an enlarged sectional view of the two processing rollers in the region of the gripper.
Figure 5:
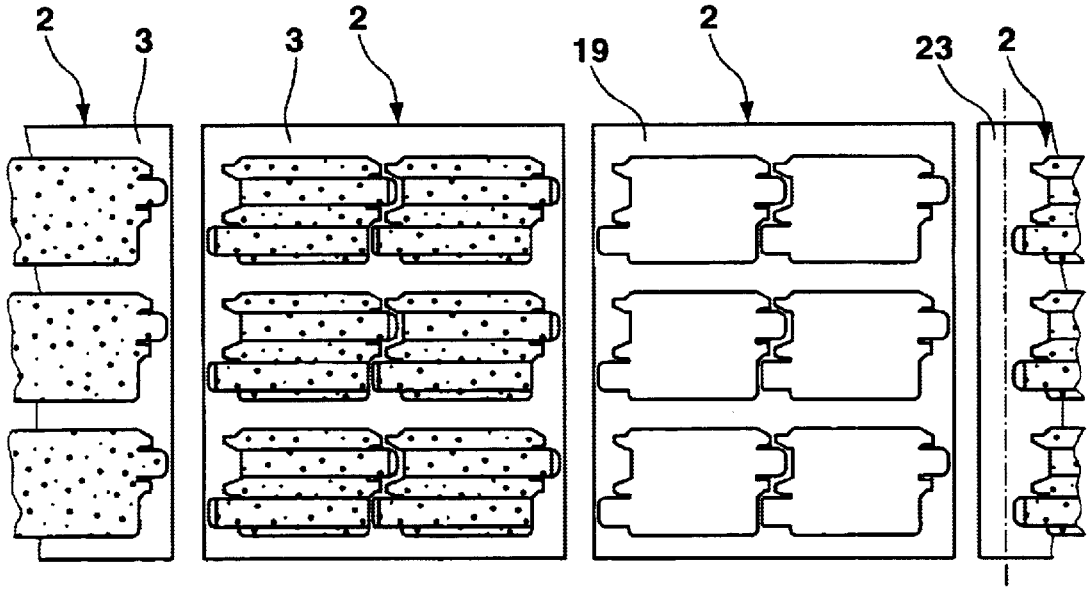
FIG. 5 shows a top view of a processing sheet with the arrangement of the cardboard pieces to be punched.

FIG. 1 shows a device, referred to in its totality with 1, for punching individual sheets of finishing material substrate 2 (FIG. 5). In particular, printed cardboard, cardboard packagings, envelopes, folding boxes, blister cards, corrugated board and multi-layer substrates can be provided for processing via a punching and/or breaking-off procedure. The substrate 2 which is to be processed as individual sheets 3 is introduced in a feed direction A (FIG. 4) between two rotating processing rollers 4, 5 and the substrate 2 is processed while passing tool parts 7 and 8, which are active in the working gap 6.

In the inventive device 1, at least one of the processing rollers 4, 5 has at least one gripper 9 (FIG. 2) which permits register-controlled grasping of the substrate 2 and facilitates its precise transport through the device 1.

Figure 2:
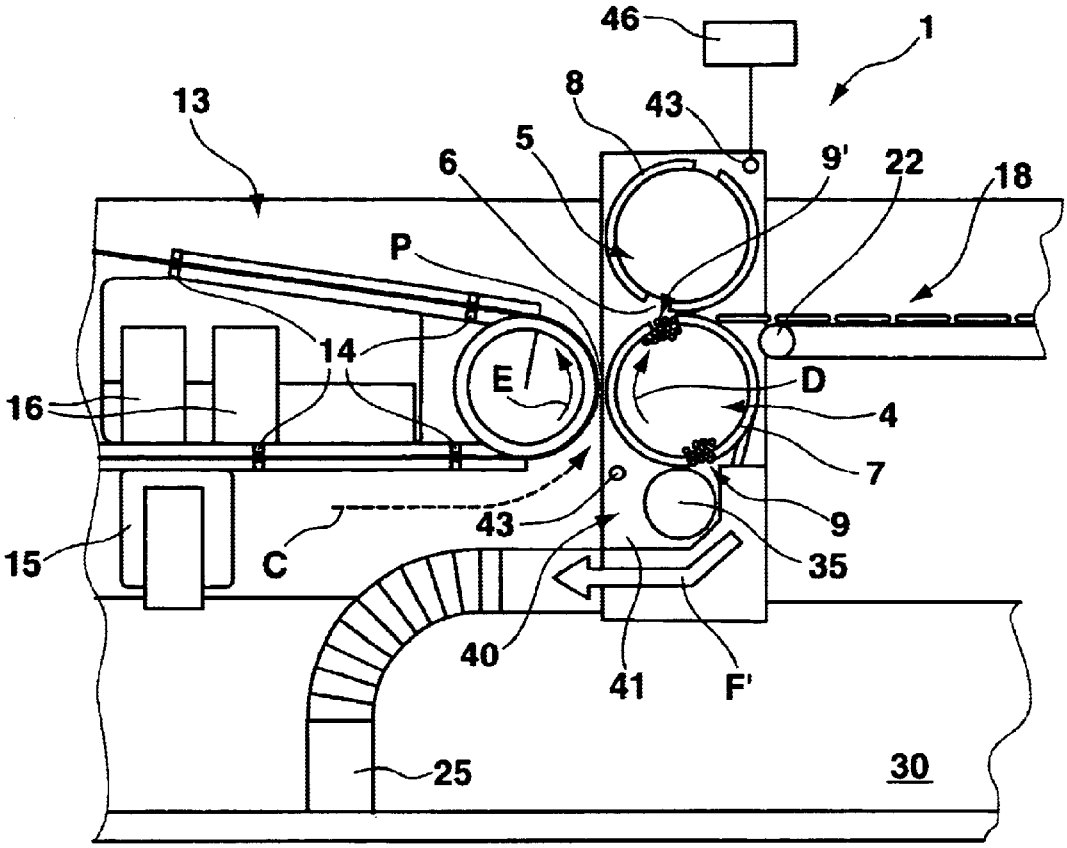
FIG. 2 shows an enlarged sectional view of the device in the region of the processing rollers and having a counter roller.
Figure 6:
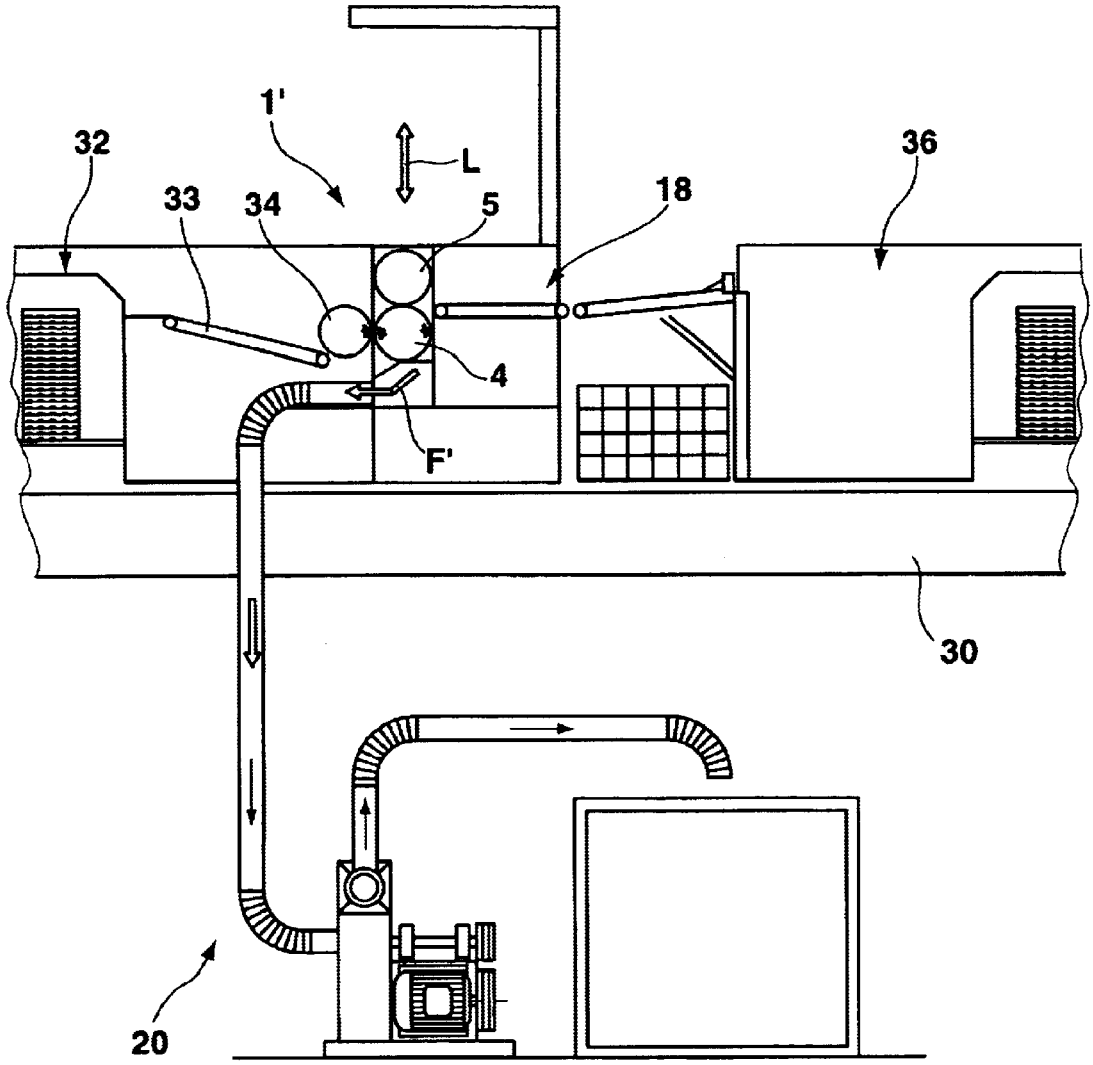
FIG. 6 shows a schematic representation of the device in a second embodiment as a separate processing station.

FIGS. 1, 2 and 6 show embodiments of the device 1 with which the lower processing roller 4 is formed as a bottom roller having two grippers 9, 9' which are mutually offset by 180°. Only one single gripper 9, 9' could also be provided on the lower processing roller 4 (bottom die) and/or on the upper processing roller (5) (male die) (not shown).

Figure 3:
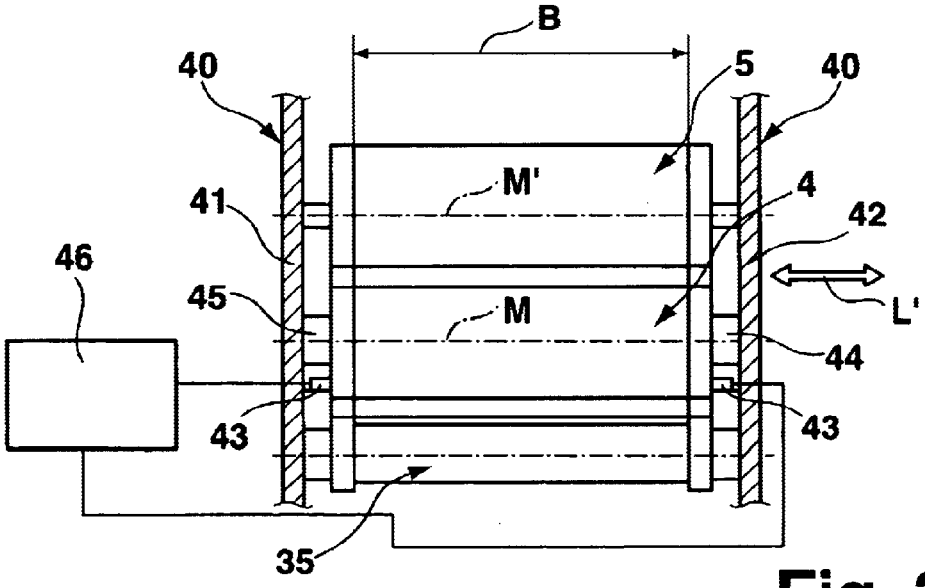
FIG. 3 shows a front view of the lower processing roller with the counter roller.

The gripper 9, 9' is preferably a gripper strip 12 which is disposed in a peripheral transverse channel 11 of the processing roller 4, and extends substantially across the entire width B of the respective roller 4 (FIG. 3). The gripper strip 12 is mounted in an adjustable fashion in the region of a support axis 10 at the ends of the transverse channel 11.

The enlarged sectional view of FIG. 2 clearly shows that the device is directly adjacent to a feed device 13 on the input side through which substrates 2, which consist of different finishing material, can be supplied in a register-controlled fashion. The feed device 13 itself is a register-controlled discharge unit disposed downstream of a sheet-printing machine (not shown in detail). The sheet-printing machine can preferably be an offset printing machine.

The feed device 13 or 34 (FIG. 6) comprises grippers 14 which each accept the substrate 2 from the sheet printing machine and supply it to the gripper 9 or 9' of the processing roller 4 in a delivery direction C (FIG. 2). A transfer position P (FIG. 1) is approached in a synchronized motion phase of the construction units. This position P of transfer of the substrate 2 to the gripper 9, 9' of the processing roller 4 can be optimally adjusted by a register adjustment in the region of the upstream sheet printing machine and also by a corresponding adjustment of the grippers 14 of the feed device 13. This register adjustment in the region of the printing machine avoids the need for adjustment of the grippers 9, 9' in the region of the roller 4 such that the device 1 does not require any actuating elements which would influence its stability.

Exact adjustment between the grippers 9, 9' and the grippers 14 is of functional importance for the accuracy of the finishing process in the device 1. In the transfer region (P), the grippers 14 of the feed device 13 pass through a path E which approaches the path D of the gripper 9, 9' of the processing roller 4 such that the substrate is simultaneously held in some phases by the gripper 14 of the supply unit 13 and by the gripper 9 or 9' of the processing roller 4 during delivery and transfer in the region P. In the region of the transfer position P, the grippers 9 and 14 cooperate along a transfer path of e.g. 1 to 5 mm. This path can be adjusted in a register-controlled fashion by ±0.01 mm.

As can be clearly seen in FIG. 2, the feed unit 13 has a lacquering and/or drying unit 15, 16 for the substrates in the region of its end facing the sheet-printing machine (not shown).

A discharge device 18 is connected downstream of the device 1 which accepts the processed substrate 2 and to which a disposing device is proximate (FIG. 1) (referred to in its totality with 20) to receive that part of the sheet 3 (FIG. 5) constituting processing waste 19 following a punching process. In this case a disintegrating means 24 is provided into which the respective waste parts 19 are fed via transport pipes 25, e.g. in a downward direction R and then discharged via pipes 25' to a bin 26. The supply pipes 25, 25' can also be connected to a central disposing unit (not shown).

The disintegrating device 24 is a disposing device cooperating with the device 1 via the supply pipe 25, which penetrates through the ceiling 30 of a building. The end 21 of device 1 facing and proximate to the processing rollers 4, 5 is connected to the discharge device 18. The discharge device 18 advantageously has a vacuum-suctioning device 22 (FIG. 4) to separate the substrate 2 from the waste parts 19 (FIG. 5). In an advantageous embodiment, the discharge device 18 is provided with a table 23 whose upper side receives and transports the substrates 2 (FIG. 5, right side). The table 23 defines, together with the lower processing roller 4, a passage gap 28 at its receiving end 21 through which the waste 19 produced by processing can pass downwardly (arrow F) towards the disintegrating device 24. The waste part 19 which is still held by the gripper 9 is carried along in the direction of arrow F and enters into the supply pipe 25 at F' (FIG. 2). At the end of the working gap 6 facing the discharge side, the substrate 2 which remains as material part is split off and separated from the waste part 19, wherein the substrate 2 is transported to the table 23 along a path 27 (dash-dotted line in FIG. 4). This separation and transport process can be advantageously supported by directing a blowing or suctioning airflow onto the substrate 2 or the waste part 19 via a device not shown in detail.

The enlarged detail of FIG. 4 clearly shows that the at least one gripper 9, 9' of the processing roller 4 is provided with a peripheral register adjustment device 31 by means of which the grippers 9, 9' can be displaced through a pivoting motion (arrow S, FIG. 4) and can be precisely adjusted about the central longitudinal axis M of the roller 4.

In addition to this adjustment possibility S, the processing roller 4 which bears the gripper 9 may also be adjustable via lateral and/or diagonal register adjustment means (not shown in detail). These permit adjustment according to arrows H and K (arrow H: diagonal register; arrow K: lateral register). Both processing rollers 4 and 5 could also have the above-described register adjustments S, H and K.

For flexible use of this device 1, the processing rollers 4, 5 are provided with replaceable processing tools at tool parts 7, 8. For a fast replacement, each processing roller 4, 5 can preferably be a magnetic roller on which the punching, grooving, perforating and/or embossing processing tools 7, 8 can be mounted.

An above-described processing step, in particular perforation of the substrate 2, can also be carried out using an auxiliary device (not shown) which is integrated in the processing line such that it is register-controlled and which is provided in the work cycle before or after the device 1.

The overall design of the device 1 also permits the processing rollers 4 and 5 to be replaced individually, completely or commonly (arrow L, FIG. 1, FIG. 6). The embodiment of the device 1 according to FIG. 2 shows an arrangement of a counter pressure roller 35 which is disposed in the region of the processing roller 4. The processing rollers 4, 5 or the counter pressure roller 35 can be integrated in a machine frame 40 in a cartridge fashion such that individual or common removal is possible in a transverse direction L' (FIG. 3) for simple replacement of the respective processing tools 7, 8 or of the entire punching cartridge or punching tools.

FIG. 6 shows a second embodiment of the device 1', which is a unit acting independently of the register of an associated printing machine 32. The substrate 2 which has been discharged from the printing machine 32, is transported by a delivery means, e.g. a conveyer belt 33, grasped by a register roller 34, introduced between the two processing rollers 4, 5 in a register-controlled fashion and subsequently delivered to a further finishing and/or piling unit 36 by the discharge unit 18. This off-line unit could also be provided with lacquering and/or drying construction groups, similar to the units 15, 16 of FIG. 6.

The device 1 for punching printed substrates is conventionally provided with a machine frame 40 supporting the processing rollers 4, 5 and having a heating and/or cooling device 43 in the region of side supports with bearings 44, 45 for the processing rollers 4, 5 (FIGS. 2 and 3). This heating and/or cooling device 43 is connected to a regulating unit 46 which detects the temperature in the region of the side supports 41, 42 to thereby influence the processing conditions in the working gap 6 between the processing rollers 4, 5 and maintain a constant axial separation between M and M'.

The regulating means 46 is particularly useful for optimizing the cutting conditions when using hard alloy or metal knifes as cutting tool parts 7, 8. It has been shown that a constant temperature of the side supports 41, 42 in the region of their bearings 44, 45 keeps the separations between the tool parts 7, 8, which are optimally adjusted to the working gap 6 for the respective substrate 3, constant over a long processing time thereby considerably reducing tool wear while maintaining high processing quality, in particular for hard alloy or metal knifes. Tool wear can also be compensated for by increasing the temperature. A temperature increase of 1° C. can e.g. compensate for and/or adjust a displacement change of 0.001 mm in e.g. the separation between the axes.

A controllable heating device in the form of a heating cartridge may be sufficient for such optimization of working conditions to improve the cutting, punching or embossing conditions in the working gap 6 in a straightforward manner. A comparing unit provided in the regulating unit has associated temperature detection means to observe deviations from the optimum value and heats (or cools) the region of the heating cartridge after a short reaction time such that the constant temperature conditions in the region of the side supports 41, 42 optimize the processing process. In addition to the heating device, a corresponding cooling device (not shown) can also be provided for delivering and discharging corresponding cooling agent in the region of the side supports 41, 42 thereby increasing the possibilities for adjustment or precise temperature change.

Figure 7:
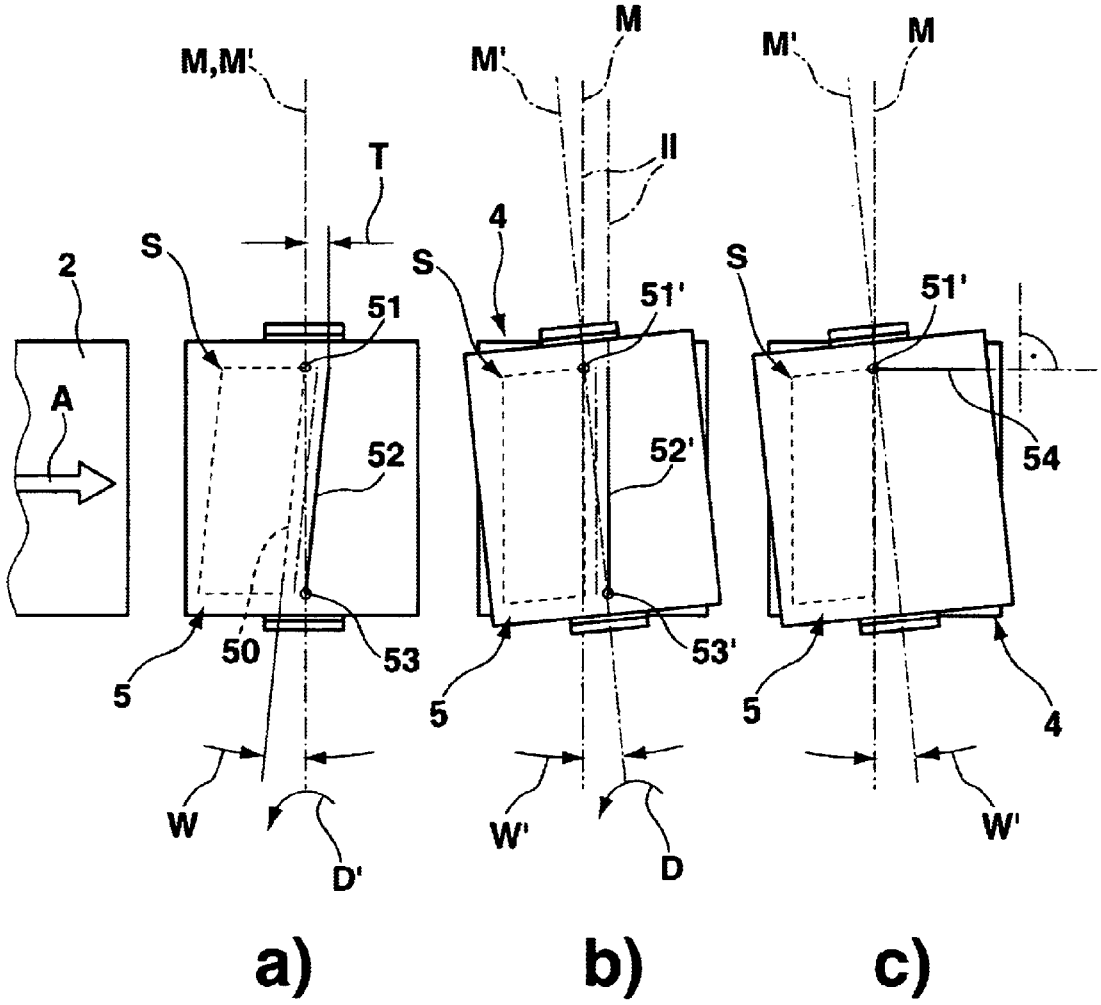
FIG. 7 shows a top view of the processing rollers with a cutting contour showing the punching process.

FIG. 7 shows top views of respective schematic representations a, b and c of the processing rollers 4, 5 of the device 1. These representations show the rolling, punching process leading to the formation of the lines of intersection on the substrate 2 supplied in a feed direction A, wherein the dotted line shows a punching contour S on the upper processing roller 5 only. In FIG. 7*a*, the axes M and M' of the two rollers 4 and 5 extend in a vertical plane, one on top of the other. Through introduction of a rotary motion D' of the roller 5 and a corresponding rotary motion D (FIG. 2) of the processing roller 4 in an opposite direction, the punch contour S (e.g. formed by a punch plate on the processing roller 5) passes into the processing gap such that in the phase shown, the punching operation for a punch line 50 starts at a point 51.

The substrate is moved further in a horizontal direction along the feed path T thereby producing the line of intersection 52 extending up to the final point 53. As a result of the punching process, this line 52 is inclined (angle W) with respect to the vertical plane containing the two axes M and M'.

Such an inclination of the punching lines is undesirable for a plurality of punch processes. Therefore, presetting is provided through adjustment in the region of the processing rollers 4 and/or 5. Rectangular and/or parallel lines of intersection can be produced relative to the feed direction A.

In FIG. 7*b*, the upper processing roller 5 with the punch contour S is inclined by the angle W' to produce a rectangular section. Starting from the point of origin 51' of the sectional view S, this construction produces a punch line 52' extending parallel to the axis M of the lower processing tool 4. The punch line 54 (FIG. 7*c*) which extends in the feed direction A is also produced and is perpendicular to the punch line 52' such that, with this inclined position of the processing roller 5, a rectangular contour S can be punched out of the substrate. This angularly precise embodiment of the punch contour is particularly required to produce lines of intersection extending in the direction of fibers in the substrate 2 (which corresponds to the feed direction A) required for subsequent processing, which can then be executed with high precision.

Figure 8:
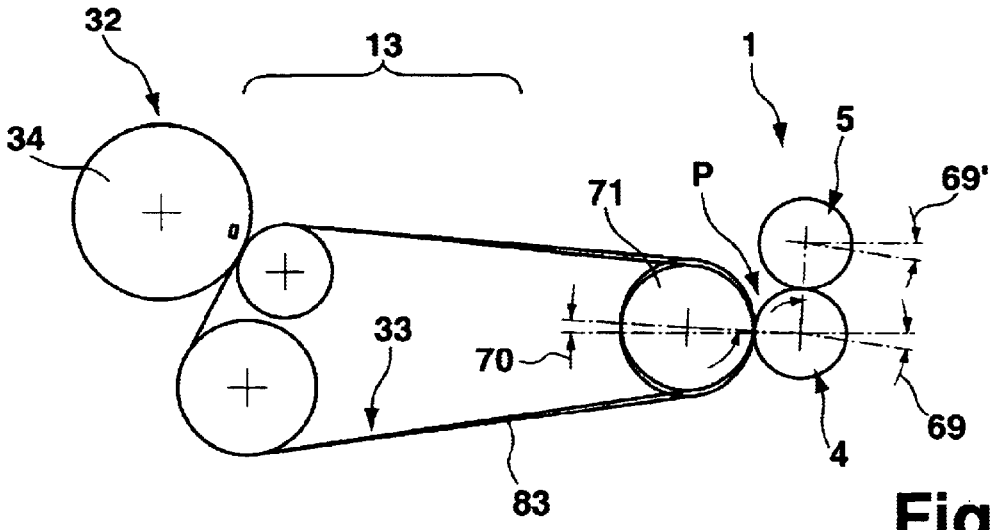
FIG. 8 and FIG. 9 each schematically illustrate the apparatus in the region of the feed device.

FIG. 8 shows possible constructively modified parts of the system for producing a rolling cut via rotary punching. In this manner, load peaks are reduced in particular during punching of transverse lines such that processing is effected with reduced punch pressure to prevent frequent resetting of the tools and to permit the novel use of narrower punching rollers (rollers 4, 5). These structural components have a ratio of diameter to width of 1:1 or less than 1:1, e.g. 1:1.2; 1:1.4 etc. These ratios in the region of the processing rollers 4, 5 permit optimum combination of such devices with conventional printing machines, e.g. offset machines, wherein the inclined position and the resulting reduced punch pressure have particularly advantageous effects. The processing rollers can be dimensioned to have the same format (circumference×width) as the image-carrying pressure roller.

The feed unit 13 passes the substrate from the printing machine 32 to the region of the processing rollers 4, 5, as is shown in more detail in FIGS. 2 and 6. The gripper strip 9 is provided for transferring the substrate in the region P and, in the embodiment of FIG. 8, is mounted to the processing roller 4 in an inclined position at a tilt angle 69. This inclined position may cooperate with axial tilting (tilt angle 70) in the region of a feed roller 71 to obtain rolling delivery and transfer of the substrate which is introduced between the processing rollers 4 and 5 at a corresponding inclination and is further transported to effect rolling lines of intersection without abrupt loading of the punching tools. An angle 69' shows an additional inclined position in the region of the processing roller 5, e.g. an inclined position of its punch plate. Tilt angles of 0.5° have been demonstrated to be feasible for all inclinations and tilts.

Figure 9:
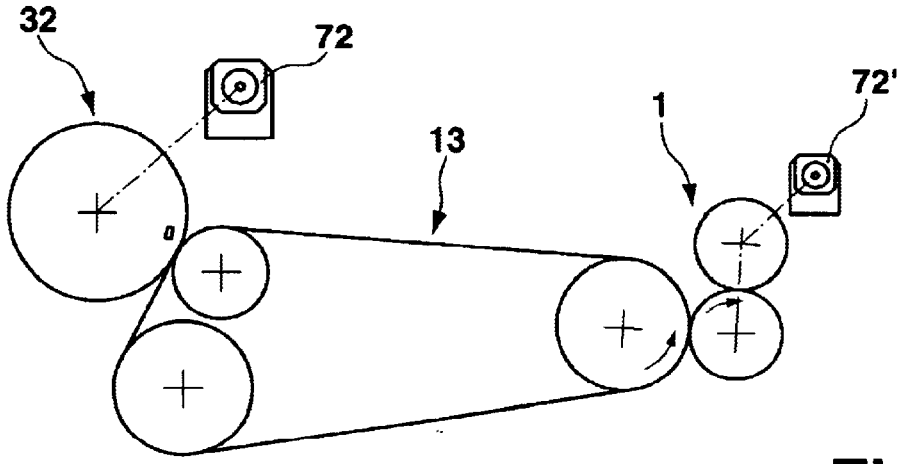
Figure 10:
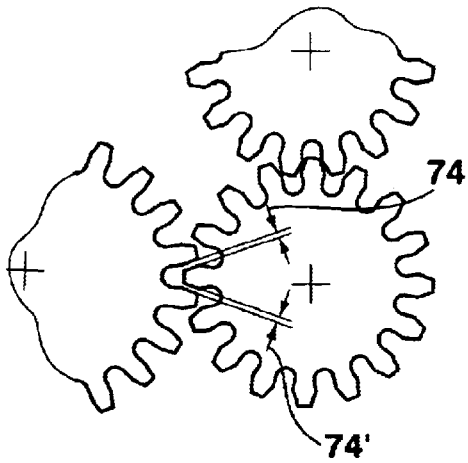
FIG. 10 shows an enlarged sectional view of a gear connection in the region of the processing rollers drive.

FIGS. 9 and 10 schematically illustrate a drive concept in the region of the printing machine 32, the feed unit 13 and the punching device 1. Each of two servo drive motors 72 and 72' has a contactless gear connection 73 (FIG. 10) to ensure synchronous drive, wherein the teeth intermesh without contacting, with a separation 74, 74' which is also constant during the drive phase. The teeth abut only in case of a control error, e.g. in the software, causing undesired overload of the system and requiring immediate switching off of the drive. This gear connection 73 provides for straightforward protection of the system, in particular the grippers 9, from damage.

Figure 11:
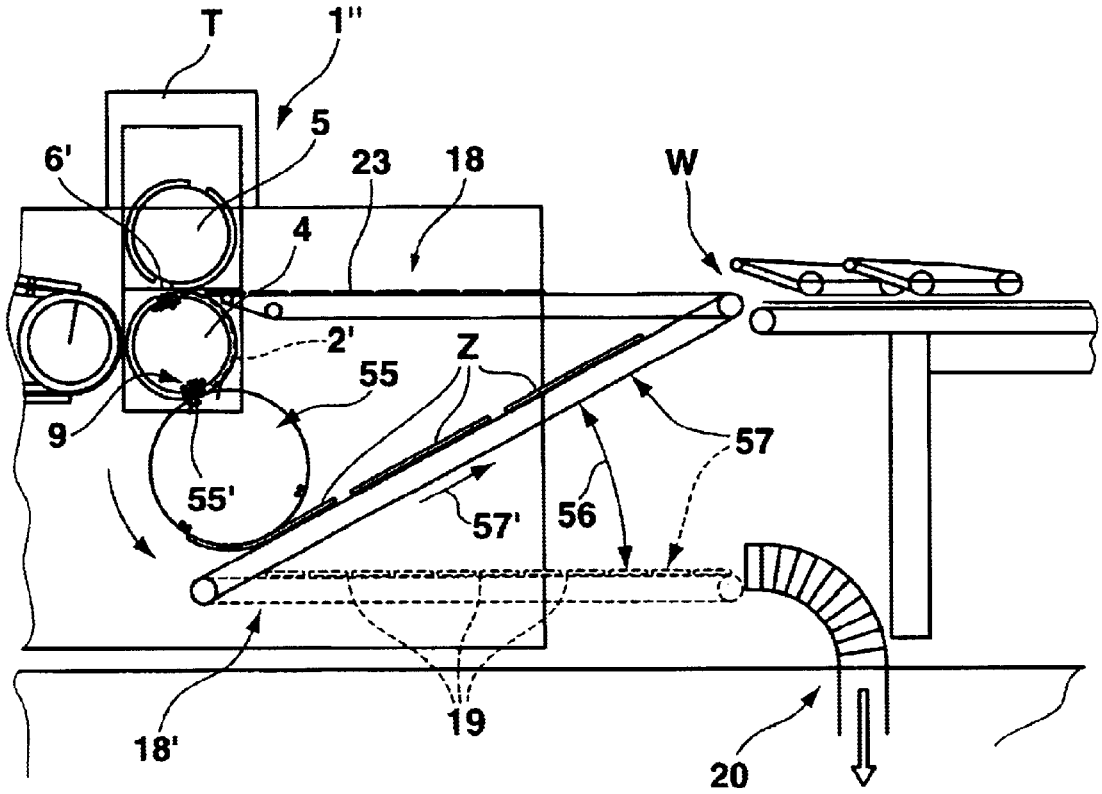
FIG. 11, similar to FIG. 1, shows a side view of the device with a delivery roller in the region of the feed device.

FIG. 11 shows the device 1" having structural components downstream of the processing rollers (4, 5) which are arranged differently than in the embodiment of FIG. 1. In addition to punching and breaking-out of the substrate (already shown in FIGS. 4 and 5) the device 1" can also be used for pre-punching. In this pre-punching process, the gripper 9 grasps the substrate in the above-described fashion and this gripping position is maintained through corresponding machine control until the substrate has passed through the processing gap between the two processing rollers 4 and 5 and the lines of intersection or the like are introduced into the substrate. FIG. 11 shows the substrate 2' with broken lines which has been processed along the full sheet length and passed through the working gap 6' to subsequently be delivered or taken over as described below.

During this holding and processing phase, the gripping strip 9 has reached the rotary position shown in FIG. 11, subtending an angle of approximately 180°, and then, together with the substrate, gains proximity to a delivery roller 55 having grippers 55' to accept e.g. the pre-punched substrates in a register-controlled fashion. This delivery roller 55 is formed as part of a discharge device 18' with which the pre-punched substrate moves, as intermediate product Z, to a discharge conveyer band 57, is disposed thereon for further transport (arrow 57'), and delivered to the band end W for final processing. The substrate 2' (dashed lines) can also be punched in the device 1" along its full length and divided into waste part 19 and finished part ("useful part") (FIG. 5) in a subsequent processing unit (not shown).

The above-described system of FIG. 11 is also provided for punching and breaking out wherein the waste part 19

(FIG. 5) is held and carried by the gripper 9 to the delivery roller 55 and is transferred to the discharge conveyer band 57 via its gripper 55'. The feed angle 56 of this discharge conveyer band 57 is changed through machine control such that a substantially horizontal feed direction can be adjusted (shown in FIG. 11 with dashed lines). The waste 19 is taken over at the end of the discharge conveyer band 57 by the disposing device 20. The conveyer band 57 can be easily pivoted back into the inclined position (arrow 56) for a punch process which is subsequently indicated by the machine control.

The arms 18 and 57 of the device 1" are structural components which can be optionally used to permit three discharge possibilities without displacing components. In addition to delivery of the substrate without punching or finishing processing, the initially punched intermediate product Z or the waste part separated from the punched useful part can be further transported.

In an extended embodiment, the device 1" may comprise a laser processing unit T in the region of the processing rollers 4, 5 for laser punching.

Figure 12:
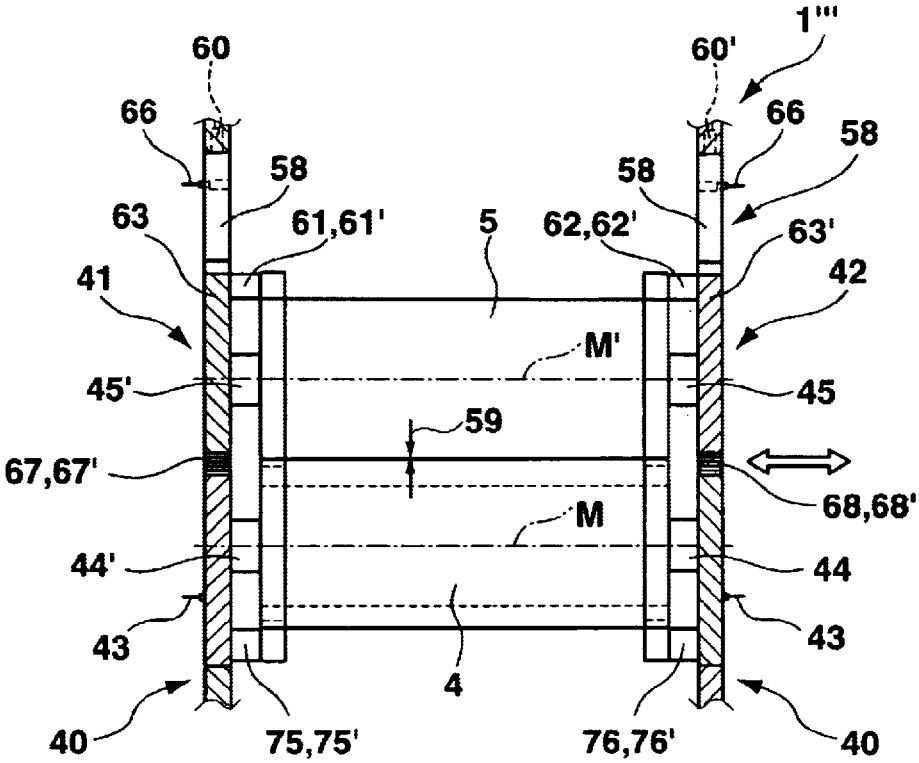
FIG. 12, similar to FIG. 3, shows a partially cut front view of the processing rollers in a machine frame.
Figure 13:
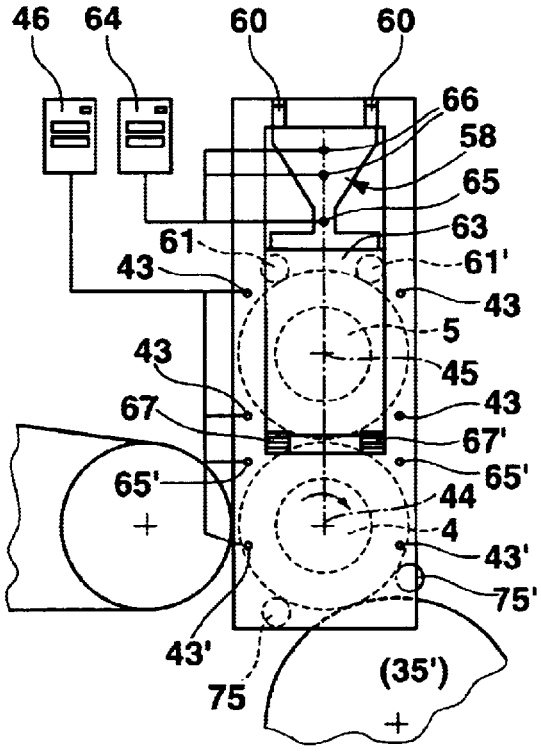
FIG. 13 shows a side view of the device with the machine frame according to FIG. 12.

FIGS. 12 and 13 show the punching device 1'" in a design which is augmented compared to the embodiment of FIG. 3. In this augmented device, the axial separation (axes M and M') between the processing rollers 4 and 5 in the operating position can be adjusted more precisely to improve the processing result. In addition to the adjustable and controllable parts described in connection with FIG. 3 and comprising a heating or cooling device 43, at least one expansion body 58 is integrated in the side supports 41, 42 of the machine frame 40 in accordance with FIG. 12. These expansion bodies 58 are supported in the machine frame 40 such that the generation of different load conditions and associated material extension can be used to adjust the axial separation between the axes M and M' and the size of a processing gap 59. The side view of FIG. 13 clearly shows that the expansion body 58 is supported via adjustment screws 60, 60' on the respective side support 41 or 42. In addition, the expansion body 58 has bearing members 63, 63' accommodating respective support rollers 61, 61' or 62, 62' which are disposed above the processing roller 5.

This system with the expansion bodies 58 above the processing roller 5 cooperates with respective spring elements in the form of spring packets 67, 67' and 68, 68' which are disposed in pairs and engage below the bearing members 63, 63' between the two processing rollers at the height of the processing gap. These spring packets are supported between the bearings 44, 45 or 44', 45' of the two processing rollers 4 and 5 on the side supports 41 and 42 such that the spring packets are integrated in the load path of the device 1'". The spring packets prevent "stick-slip" during processing steps (punching or punching out) carried out under sliding friction conditions in the bearings 44, 45; 44', 45'. This stick-slip effect which is caused by the periodic changes between moving and stationary phases, causes undesired oscillations. These are eliminated by this spring packet-construction of the system.

In addition to the regulating unit 46 shown in FIG. 3, a second regulating unit 64 is connected to the above-described expansion body 58 and cooperates with a temperature sensor 65 and one or more heating cartridges 66 such that fine adjustment in the region of the processing gap 59 can be effected via a corresponding temperature change in the region of the expansion body 58. With this temperature change, the processing gap can be varied within an adjustment range of +/−0.1 mm, by e.g. stepping a micrometer, to achieve precision adjustment. The adjusting screws 60, 60' permit coarse adjustment for relative mutual positioning of the processing rollers 4, 5 in their operating position, e.g. after exchange of the punch plates. A meter or the like (not shown) could be provided in the region of the side supports 41, 42 as a fixedly mounted adjustment aid.

The above-described adjustment motion is also particularly effective in the region of the spring packets 67, 67'; 68, 68'. The parts in the region of the roller bearings 44, 45 are pretensioned through the expansion body 58 and the support rollers 61, 61'; 62, 62' to prevent an undesired bouncing of the rollers 4 and 5 during processing in response to the punch pressure. An important precondition for the function of the above-described coarse adjustment or fine adjustment using the expansion bodies 58, is that the bearings 44, 45; 44', 45' of the processing rollers 4 and 5 do not utilize conventional bearer ring contacts. These bearing parts can be omitted since the support rollers 61, 61'; 62, 62' and the pretensioned roller bearings are integrated in the structure of the machine frame. In addition to the above described upper support rollers 61, 61'; 62, 62', respective support rollers 75, 75' and 76, 76' are provided below the lower processing roller 4 which act in the manner of a counter pressure roller 35 (FIG. 3).

The above-described system permits straightforward, fine adjustments in the region of the expansion body 58 to permit adjustment of the device 1'" to different material thicknesses of the substrate 2 as well as to allow for compensation, controlled by the regulating unit 64, for tool wear in the region of the punching tools. The inventive embodiments of the processing device thereby constitute an overall construction unit which can also be used in similar configurations for embossing, grooving, perforating, hologram embossing, numbering or the like.

Figure 14:
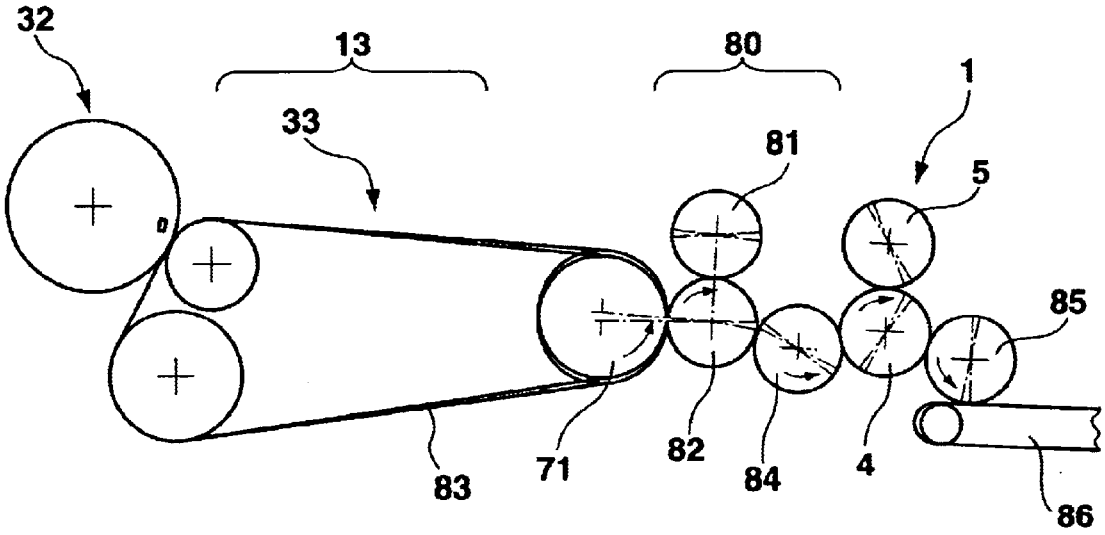
FIG. 14, similar to FIG. 8, schematically illustrates a second processing module connecting to the punching device.

Similar to FIG. 8, FIG. 14 shows a schematic representation of the punching device 1 with inclined (angles 69, 69', 70 according to FIG. 8) roller bodies 4, 5 and 71, with a second processing module 80 being connected upstream of the punching device 1. The punch roller pair 4 and 5 and a roller pair 81 and 82 are each disposed at right angles to the longitudinal axis of the machine to provide passage of the substrate in the direction A (FIG. 7). Mounting of each of the punch plates (not shown in detail) of the system of FIG. 14 to the front and rear punch roller pair 81, 82 or 4, 5 at an inclination produces a rolling travel for the transverse lines between the respective upper and lower rollers provided that the substrate or the sheets are guided through the device with the same inclination as the punch plates.

This system is advantageous in that the processing plates provided for the roller pairs 4, 5 or 81, 82 can be produced with the usual geometry and the useful punch regions on the substrate are not reduced in size. For operation with full punch rollers, punch shells or tools, the punch lines are generated such that they are displaced by the angle of inclination.

During passage, the unprinted substrate is grasped at its front edge, guided through the printing station 32 via grippers and printed by printing tools in a manner known per se (left side, FIG. 14). The substrate, which is also held at the front edge by grippers, is then grasped in the chain delivery 83, provided as conveyor 33, or the register roller 34 (FIG. 6) and transferred to the device 1 or 80 in the region of the lower punch roller 4 or 82 with the gripper mounted at an inclination. The height of the drive side in the region of the processing rollers 4, 5 or 81, 82 is thereby offset from the respective operating side by the tilt angle (dash-dotted in FIG. 14) such that the gripper strip of the lower processing roller(s) also has the corresponding inclined position and the delivery during processing of the substrate takes place with the required inclination.

Gripping strips (not shown in detail) are also mounted at an inclination with respect to the paraxial transfer rollers 84 and 85, to effect smooth delivery of the substrate, which is inclined in the transport direction, to the module 80. In the region of a downstream arm 86, the substrate is received "without rotation" in a position extending in the conveying direction A by also displacing the arm 86 through the tilt angle (dash-dotted representation). The tilt angle is 0.5° for each of the above-described components, such that the substrate is transported on the arm 86 parallel to the feed direction.

I claim:

1. A device for producing a finished part and a waste portion residue by finishing, processing, cutting, and punching printed cardboard, cardboard packagings, corrugated board, paper and similar substrates using a rotary punching process, the device comprising:

a first rotating processing roller;

a second rotating processing roller, said second processing roller cooperating with said first processing roller to define a working gap between said first processing roller and said second processing roller;

tool parts disposed on at least one of said first processing roller and said second processing roller to process the substrates when those substrates are inserted in a feed direction into said working gap;

at least one gripper disposed on at least one of said first processing roller and said second processing roller, said at least one gripper effecting a register-controlled transport of the substrates; and means for splitting off and separating the finished part from the waste portion.

2. The device of claim 1, wherein said gripper holds the waste portion after processing and removes it from said working gap.

3. The device of claim 1, wherein said splitting-off and separating means comprise means for holding the waste portion and for removing the waste portion from said working gap using at least one of suctioning and pressurized air.

4. The device of claim 1, wherein said splitting-off and separating means comprise a discharge device for accepting the finished part and a disposal device for accepting the waste portion, said discharge device and said disposal device positioned downstream of said first and said second processing roller.

5. The device of claim 4, wherein said splitting-off and separating means comprise at least one of a vacuum suction device and a pressurized air system disposed proximate an end of said discharge device facing said first and said second processing roller to assist in separating the finished part from the waste portion.

6. The device of claim 1, further comprising a laser processing unit disposed proximate said first and said second processing roller.

7. The device of claim 1, wherein said splitting-off and separating means comprise a module member having selectively applicable discharge devices to facilitate a three-fold discharge option without having to displace components.

8. The device of claim 7, wherein said module member comprises means for discharging the substrate without processing, means for discharging a pre-punched intermediate product, means for discharging the waste portion separated from the punched-out finished part, and means for discharging the finished part.

9. The device of claim 1, wherein said splitting-off and separating means comprise a delivery roller disposed downstream of said first and said second processing roller to receive the substrate.

10. The device of claim 9, wherein said splitting-off and separating means comprise a discharge conveyer band having an adjustable conveying angle, said conveyer band receiving the substrate from said delivery roller.

11. The device of claim 1, further comprising a feed device disposed directly upstream of said first and said second processing rollers at a reception side thereof to supply the substrates in a registered manner.

12. The device of claim 1, wherein said splitting-off and separating means comprise a downstream discharge device to receive at least one of a punched-out substrate and an initially punched intermediate product and a downstream disposal device to receive the waste portion.

13. The device of claim 12, wherein said disposal device comprises at least one of a vacuum suctioning unit disposed proximate to an end of said discharge device facing said first and said second processing rollers and an air blowing system, said at least one of said vacuum suctioning unit and said air blowing system for supporting separation of the substrate from the waste portion.

14. The device of claim 12, wherein said discharge device comprises a table whose upper side receives and transports the finished parts, wherein a receiving end of said table defines, together with a lower one of said first and said second processing roller, a passage gap for downward passage of the waste part to said disposal device.

15. The device of claim 12, further comprising a delivering roller disposed for accepting the substrate from a lower one of said first and said second processing roller as an intermediate product, wherein said discharge device comprises a discharge conveyer band having an adjustable conveying direction and cooperating with said delivery roller.

16. The device of claim 9, wherein said delivering roller comprises grippers to transfer the substrate, processed over an entire length thereof, to said delivery roller.

17. The device of claim 1, wherein said tool parts are structured and disposed to generate a rolling, stamped-line path on the substrate.

18. The device of claim 17, wherein said first and to said second processing rollers have ratio of diameter to width which is less than or equal to 1:1.

19. The device of claim 18, wherein said ratio is less than one of 1:1.2 and 1:1.4.

* * * * *